United States Patent [19]

Tann

[11] 4,238,651

[45] Dec. 9, 1980

[54] SNAP ACTION FLUID PRESSURE SWITCH

[75] Inventor: David Tann, Detroit, Mich.

[73] Assignee: Electro-Mechanical Products, Detroit, Mich.

[21] Appl. No.: 2,577

[22] Filed: Jan. 11, 1979

[51] Int. Cl.[3] ..... H01H 35/34

[52] U.S. Cl. ..... 200/83 P; 200/83 N

[58] Field of Search ..... 200/83 R, 83 A, 83 B, 200/83 S, 83 N, 83 P, 81 R, 81.4, 82 R

[56] References Cited

U.S. PATENT DOCUMENTS

| | | | |
|---|---|---|---|
| 1,908,088 | 5/1933 | Warner | 200/83 N |
| 2,392,077 | 1/1946 | Wilson | 200/83 P |
| 3,335,244 | 8/1967 | Mejean | 200/81.4 |
| 3,908,105 | 9/1975 | Schuler | 200/83 R |
| 4,006,083 | 2/1977 | Westervelt | 200/83 P |

FOREIGN PATENT DOCUMENTS

| | | | |
|---|---|---|---|
| 1024265 | 2/1958 | Fed. Rep. of Germany | 200/83 N |

*Primary Examiner*—Gerald P. Tolin

*Attorney, Agent, or Firm*—Krass & Young

[57] ABSTRACT

A snap action fluid pressure actuated switch, including a switch housing within which is mounted a metallic dome-shaped disc which is dimpled in its center by a predetermined pressure differential to provide a snap action, while being biased to eliminate the deformation and return the switch after the pressure differential declines. The disc is secured to a spool contact movably by the snap action of the disc into and out of electrical contact with either of a pair of contact plates to create an electrical connection between a terminal electrically connected to the metallic disc and either of a pair of terminals connected to a respective contact plate. The free end of the spool contact is piloted at its free end and adjustable fixed stops are provided to position the spool contact in the connected metallic disc at either end point of the snap action movement, while enabling adjustability in the end positions of the spool contact and the pressure conditions causing the snap action to occur.

11 Claims, 7 Drawing Figures

SNAP ACTION FLUID PRESSURE SWITCH

BACKGROUND DISCUSSION

There are many applications for fluid pressure actuated switching arrangements in which the development of a predetermined differential triggers the switching. Internal combustion engines are currently equipped with extensive emission control equipment which often requires the use of electrical switching controlled by engine manifold pressure. Since such pressure is below atmospheric, this is often referred to as engine manifold vacuum.

A typical design for such application consists of a pressure responsive actuator such as a spring-biased diaphragm disposd in a housing, with one side of the diaphragm being exposed to atmospheric pressure and engine manifold pressure applied to the other side, together with a microswitch actuated by movement of the diaphragm in response to the engine mainfold vacuum conditions.

For automotive applications, the cost of manufacture of the device is of paramount importance due to the extremely large volume production required. Thus, the switching action while being extremely reliable, and while also the pressure conditions at which the switching is activated should be able to be set within reasonably close limits, these ends must be met without entailing precision manufacturing processes so as to enable low cost manufacture of the switch.

A general requirement of electrical switching technology is that the contacts should be made and broken rapidly such as to prevent an arcing condition developing at the contacts as they approach or recede from each other.

Such arcing can be prevented by a snap action pressure switch.

Such snap action arrangements which have heretofore been provided have been relatively complex requiring a movable piston or auxiliary contact or spring in executing the snap action motion. Such snap action motion should desirably be highly reliable in operation for the reasons noted and should occur at appropriately closely controlled pressure conditions.

The existence of a hysteresis condition also insures that arcing of the contact will be held to a minimum, i.e., that the snap-over pressure conditions causing movement to either position of the snap action actuator should differ by a significant degree such that a fluttering of the contacts does not occur at the snap-over pressure.

The reliability of the switching arrangements in which there are incorporated fluid actuated elements may be adversely affected, if the movable element carries the electrical lead which is secured thereto and if any significant degree of flexing of the movable element occurs. This is because there is a tendency for strain in the flexing element to disrupt the bond between the electrical lead and the movable element, especially a problem in the switch is required to operate over an extended period of time.

Finally, since such switching arrangements may require either single or double poles, the switching configuration should be such as to be readily adapted to a single or double pole application.

Accordingly, it is an object of the present invention to provide a fluid pressure actuated switching arrangement in which the switching is executed by the actuator device itself to thus eliminate the need for separate switches and to thereby simplify and reduce the costs of the switching arrangement.

It is a further object of the present invention to provide such a fluid pressure actuated switch which is extremely simple in construction and which is easily adapted to either single or double pole configurations.

it is yet another object of the present invention to provide such a switching arrangement which is extremely reliable in operation and which the pressure conditions producing actuation of the switch are adjustable such as to insure accurate control over the actuating pressure conditions.

It is yet another object of the present invention to provide such a switching arrangement in which the movable element actuated by the pressure condition acts as an electrical conductor, but in which the electrical lead is not bonded to the element, such that the flexing movement of the pressure actuated element does not produce a disruption of the electrical connection.

SUMMARY OF THE INVENTION

These and other objects of the present invention, which will become apparent upon a reading of the following specification and claims, will be accomplished by a fluid activated switch in which a metallic dome-shaped disc element is mounted within a switch housing and across which a pressure differential is developed to carry out the switching action. The metallic disc also acts as an electrical connection by virtue of a contact ring loosely contacting the disc at its outer periphery thereof.

A spool contact is mounted to the metallic disc in the central region thereof, secured thereto by an elongated threaded connector which is flexibly and resiliently mounted by a seal extending about a small opening in the central region of the metal disc, such as to seal the opening and enable a nonrigid securement of the movable spool contact to the metallic disc.

The movable spool contact in turn has a flange portion having electrical contacts on either side thereof disposed between a pair of spaced electrical contact plates, each having central openings therein, one of which receives the threaded fastener securing the spool contact to the metallic disc, and the other receiving a pilot portion integral with the spool contact, which passes into a guide bore such as to maintain the spool contact centered within the contact plate central openings.

Snap action deformation of the metallic disc occurs by a localized pressure induced deformation of the dome-shaped disc in the central region thereof, which produces the snap action movement of the connected spool contact, but which maintains a biasing of the spool contact into the position corresponding to the undeflected condition of the metallic disc. This provides a normally closed switch condition for one of the switch poles consisting of one of the contact plates.

The end point positions of the spool contact is controlled by adjustable stop means represented by an adjustable stop threadably engaged in a bore formed in a housing end wall and coming into contact with the head of the threaded connector in the actuated position of the metallic disc and by a threaded mounting of the element which is formed the guide bore receiving the pilot portion of the spool contact which adjustably forces the control of the position of the outer contact plate and thus the normal end position of the spool contact.

The spool contact is accessible through the pilot guide bore and is provided with a screw slot to enable an adjustment of the spool contact on the threaded connector to control the position of the contacts on the spool contact with respect to the contacts on the respective contact plates.

This accurately controls the deflection of the metallic disc and the pressure differential conditions at which the snap action occurs.

The metallic disc is loosely mounted in the housing to accommodate slight radial expansion thereof during snap action movement and is biased against an O-ring seal insuring the sealed condition of the subchamber on either side of the metallic disc. The contact ring and each of the contact plates have terminal blade portions which extend through a molded form portion of the switch housing and protrude such as to be matable with an electrical connector.

DETAILED DESCRIPTION

In the following detailed description, certain specific terminology will be utilized for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
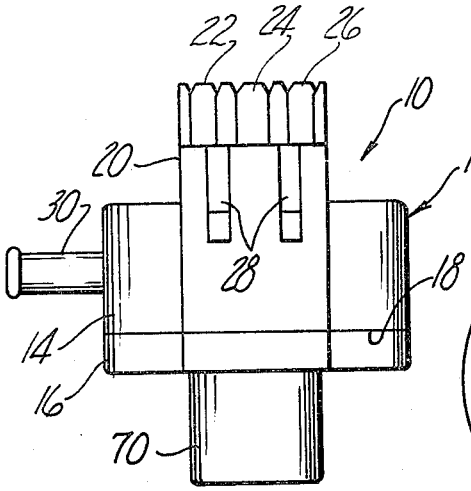
FIG. 1 is a side elevational view of the snap action pressure switch according to the present invention.
Figure 2:
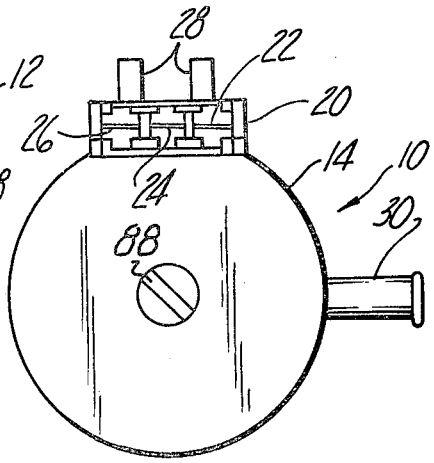
FIGS. 2 and 3 are endwise views of the snap action pressure switch shown in FIG. 1 from opposite sides thereof.
Figure 3:
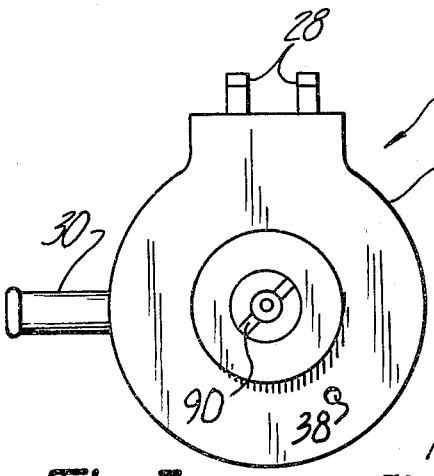

Referring to the drawings and particularly FIGS. 1 through 3, the snap action fluid pressure switch 10 is of a type adapted to the applications described above. It consists of a cylindrical housing 12 which may be formed in two differing parts, a main housing portion 14 and a cover portion 16 which are permanently joined along the interface 18 as by ultrasonic welding. The main housing portion 14 includes a molded electrical connector portion 20 which receives blades contacts 22, 24 and 26 constituting terminal means electrically connected in normally closed and open states of the switch as will be described hereinafter. The blade contacts 22, 24 and 26 are adapted to mate with a suitably configured standard electrical connector which is received over the electrical connector portion 20 and secured thereto by molded projections 28.

A hose fitting is provided which has an internal passage communicating with a pressure chamber within the cylindrical housing 12 and adapted to receive flexible rubber tubing connected to a carburetor or other engine manifold pressure source, as per conventional practice in automotive engine design.

Figure 4:
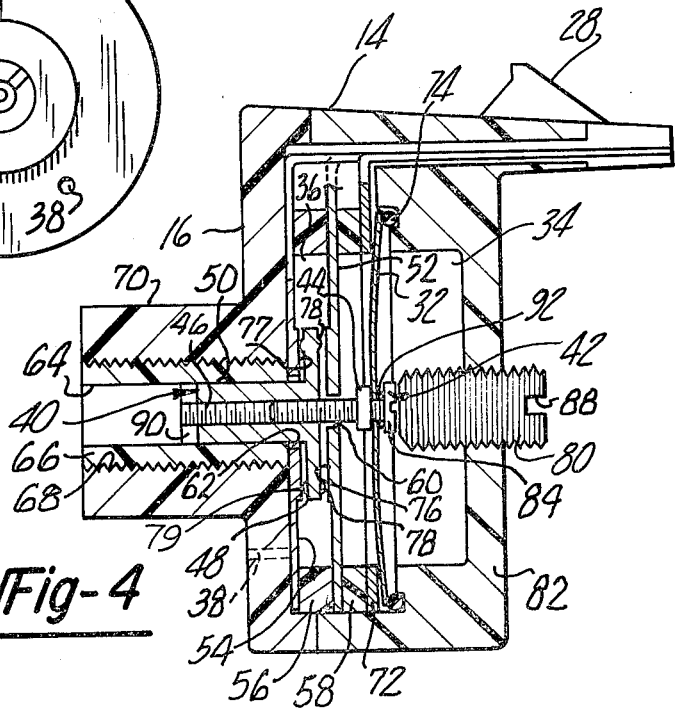
FIG. 4 is a view of a section of the pressure switch shown in FIG. 1.
Figures 5, 6, 7:
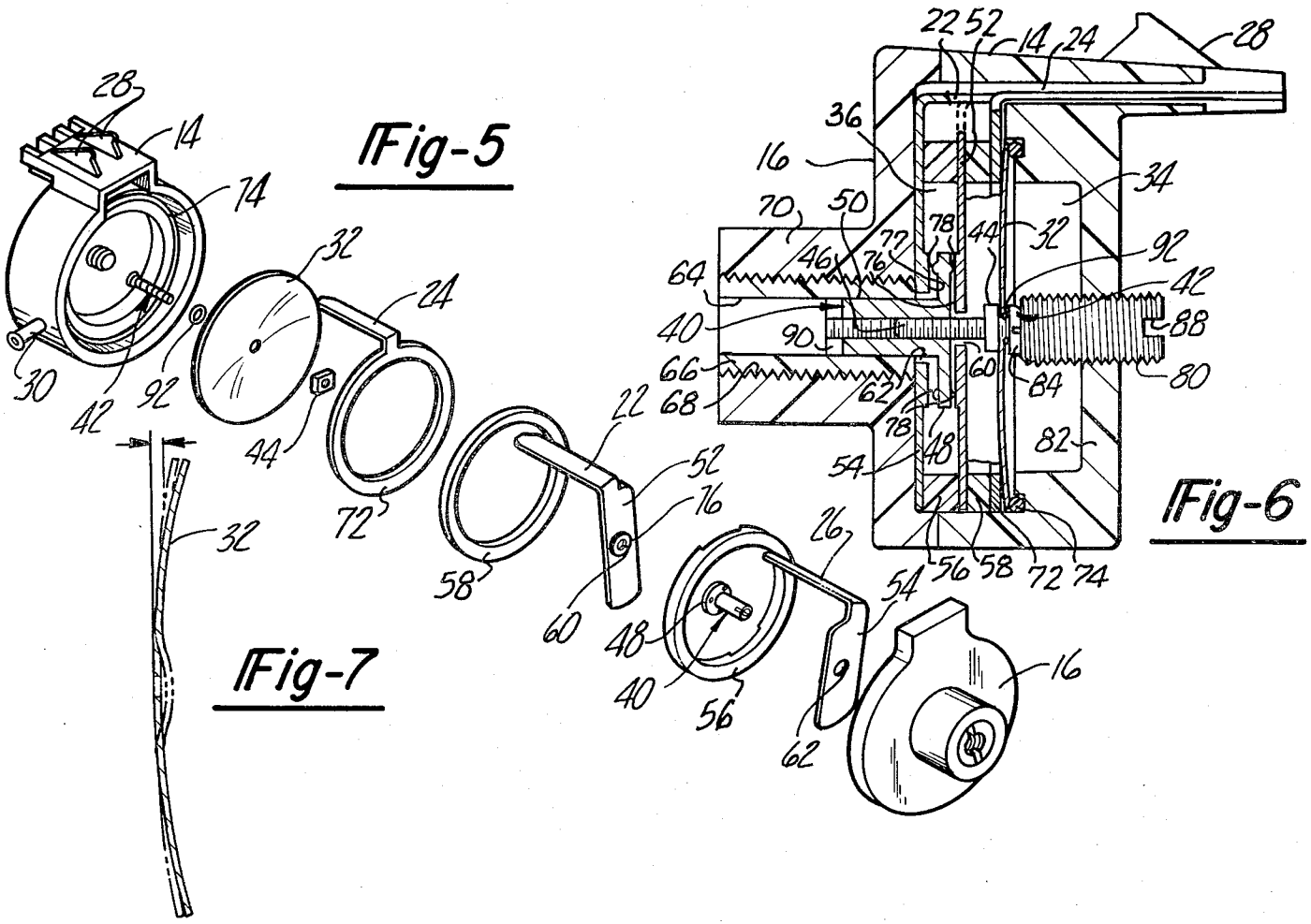
FIG. 5 is an exploded view of the components of the snap action pressure switch shown in FIGS. 1 through 4.
FIG. 6 is an enlarged detailed view depicting the connection of the threaded connector of the spool contact to the movable metallic disc and the mounting of the disc within the switch housing.
FIG. 7 is an enlarged view of the metallic disc depicting in exaggerated form the deflection of the metallic disc occurring during the snap action movement.

Referring to FIGS. 4 and 5, the internal workings of the fluid pressure switch can be seen. The cylindrical housing 12 has an internal cavity which is divided into two different pressure chambers by a movable conductive member, consisting of a dome-shaped metallic disc 32. The region on the right as viewed in FIG. 4 constitutes a pressure chamber 34 into which the engine manifold pressure is applied via hose fitting 30. A second pressure chamber 36 is defined by the portion of the cavity to the left of the metallic disc 32, as viewed in FIG. 4.

The pressure chamber 36, for the particular application described, is subjected to atmospheric pressure, via a vent opening 38, which may also be provided with a filter in order to prevent the entrance of contaminants into the pressure chamber 36, since this chamber also contains electrical contacts to be described. Thus, the snap action fluid pressure switch is responsive to the differential pressure existing in chambers 36 and 34. Since the pressure in pressure chamber 34 is engine manifold pressure, for the particular application described, i.e., a vacuum, the pressure differential tends to urge the metallic disc 32 to the right as viewed in FIG. 4.

The metallic disc 32 is dome-shaped such as to tend to be retained in the left-most position as depicted in FIG. 4, with the stiffness of the material resisting the rightward movement tending to occur as a result of the pressure differential forces.

Secured to the metallic disc 32 is an elongated spool contact member 40 which moves together with the center region of the metallic disc 32. This securement is by means of a threaded connector element 42 which passes through the center of the metallic disc 32 and is retained there by a threaded element 44 on the threaded stem section 46 of the threaded connector element 42, which also extends into an internal threaded bore formed in elongated spool contact member 40, such as to be joined thereto for axial movement together with the center region of the metallic disc 32.

The elongated spool contact member 40 is formed with a radial contact flange 48 which extends radially outwardly from a pilot portion 50 formed integrally therewith. The radial contact flange 48 is formed with contacts 78 on opposite radial faces thereof. The radial contact flange 48 is disposed intermediate a pair of electrical contact plates 52 and 54 which are electrically isolated from each other by means of a dielectric spacer ring 56 with the contact plate 52 being spaced and electrically isolated from the metallic disc 32 by a similar annular dielectrice spacer ring 58.

The threaded stem section 46 of the threaded connector element 42 passes through a central opening 60 in the contact plate 52, the pilot portion 50 of the elongated spool member 40 passing through a similar central opening 62 in the contact plate 54 with a clearance therebetween such as to insure that no electrical contact is made with the threaded stem section 46 or the pilot portion 50.

The pilot portion 50 is received within a guide bore 64 formed in a threaded sleeve 66 received in a threaded bore 68 formed in a boss 70 integral with the lower cover portion 16. This element is preferably constructed of a suitable low friction material such as nylon to allow a free sliding fit of the pilot portion 50 in the guide bore 64.

This controls the radial position of the elongated spool contact member 40 during its movement to insure that contact is not made with the surface thereof and the respective contact plates 52 and 54.

The metallic disc 32 is itself an electrical conductor and is electrically connected to one of the terminal connections controlled by the switching arrangement by an annular contact ring 72 which is seated atop the metallic disc 32 and beneath the dielectric spacer ring 58.

An O-ring seal 74 is provided beneath the metallic disc 32 which serves to seal the metallic disc 32 against the housing, upon compression thereof within the housing portions 14 and 16, with the stacked dielectric spacer rings 56 and 58, the contact plates 52 and 54, and the annular contact ring 72.

Terminal means are provided by each of the contact plates 52 and 54 and the annular contact ring 72 being integrally formed with the blade contacts 22, 24 and 26, respectively, which are bent at right angles thereto to extend through appropriate openings formed in the electrical connector portion 20 so as to protrude as seen in FIG. 1.

The opposing faces of the electrical contact plates 52 and 54 are formed with boss portions 76 and 77, respectively, which serve to move into electrical contact with the contacts 78 formed on the radial contact flange 48 of the elongated spool contact member 40.

Adjustable stop means controlling the end positions of the elongated spool contact member 40 is provided, including an adjustable stop 80 extending axially through the top wall 82 of the main housing portion 14 through a threaded bore to be adjustably positioned by a screwdriver slot 88 (FIG. 2) so as to engage a head portion 84 of the threaded connector element 42 upon its extreme movement to the right as viewed in FIG. 4 when the pressure differential is developed sufficiently. In this position, the contacts 78 formed on the radial contact flange 48 of the elongated spool contact member 40 comes into electrical contact with the boss portion 76 of the electrical contact plate 52, thus making an electrical connection between blade 24 and blade 26.

In the absence of a sufficient pressure differential to overcome the stiffness of the metallic disc 32, the contact 78 and the elongated spool contact member 40 are in the leftmost extreme position against a stop constituted by an abutment against the boss portion 76 of the electrical contact plate 54 to thus establish a connection between the blade 24 and the blade 22.

The switch therefore acts as a single pole-double throw switch.

The position of the electrical contact plate 54 may be adjusted somewhat by the provision of the threaded sleeve 66 which is provided with a suitable slot 86 as seen in FIG. 3.

The elongated contact spool member 40 is also provided with a screwdriver slot 90 which is accessible through the guide bore 64 to allow adjustment thereof on the threaded connector element 42 such as to insure the contact thereof with the electrical contact plate 52 in the activated position of the metallic disc 32.

The adjustments to the end point positions allow precise control over the pressure conditions which will produce activation of the metallic disc 32 and similarly its return to the normal condition, such that a relatively simple configuration and relatively precise control over these pressure values can be achieved.

It has been found that in making the connection of the elongated spool contact member 40 to metallic disc 32, there is required a degree of "give" in the connection since the flexing of the snap action precludes a direct mechanical bonding of these parts together. At the same time, there must be a sealing of the metallic disc 32 in order to define the pressure chamber 34. These needs are met by the provision of the threaded fasteners 42 and an O-ring seal 92 placed beneath the head portion 84 as best seen in FIG. 6, which O-ring seal 92 seals the opening and provides a degree of resiliency in the securement, such as to enable slight relative movement of the threaded connector element 42 and the metallic disc 32.

There also is a slight radial expansion of the metallic disc 32 as it is deflected in the snap action movement and a slight radical clearance indicated at 94 is therefore provided about the outer edge of the metallic disc 32. This expansion is accommodated by the O-ring seal 74 while maintaining the sealing of the pressure chamber 34.

FIG. 7 indicates the nature of deflection of the metallic disc 32 in executing its snap action movement. The snap action movement is created by a limited deformation of a portion of the metallic disc by a predetermined pressure differential in its central region only, in which a reverse curvature or "dimple" is produced in this region, rather than a reversal of the entire metallic disc.

This nature of limited deformation is such that a residual resilient force is exerted by the portions of the metallic disc 32 which are not reversely curved, urging the dimple back into its undeformed state.

This characteristic is necessary since a complete snap over of the metallic disc 32 to its reverse form would preclude further cycling of the switch.

This dimpling at the same time produces the desired snap action movement, but which snap action movement results in the restoring force exerted on the central region thereof.

This restoring force is such that a certain degree of hysteresis occurs. That is, for a given pressure differential creating the snap action movement described, the pressure differential must decline significantly below the initiating pressure differential in order to allow restoring of the central region indicated at 96, thus creating the desired hysteresis characteristic.

The total axial travel for typical application will be relatively slight and must be carefully controlled by the adjustment of adjustable stop 80 and the threaded sleeve 66. As for example, the axial travel in a typical application would be roughly 0.020 inch.

A relatively sensitive snap action will occur once the end position stops are properly adjusted to allow a high degree of sensitivity to slight pressure differentials. This is significant in the context of vacuum operated pressure switching since at most, only atmospheric pressure is available for switching actuation.

The metallic disc 32 is preferably constructed of a material which is electrically conductive and has the required degree of resiliency and resistance to fatigue failure. Such a need is provided by a half-hard beryllium copper of 0.010 inch thickness suitably heat treated to the half-hard condition.

The design of the other elements is basically dictated by their electrical properties and considerations of cost.

The housing portions 14 and 16 may be of a suitable molded plastic and adjustable stop 80 and threaded sleeve 66 of molded nylon. The threaded connector element 42, forming an electrical connection, may be metallic as must be the elongated spool contact member 40 which may advantageously be manufactured at relatively low cost by providing a brass screw machine product having silver contacts 78 electro-deposited or otherwise formed thereon.

As previously noted, threaded sleeve 66 is of nylon to provide a good sliding fit. The electrical contact plates 52 and 54 and the annular contact ring 72, requiring electrical conductivity, are advantageously constructed of brass and the blades 22, 24 and 26 silver plated to improve the conductivity thereof.

It can be appreciated that the switches may be configured in various alternate versions as for example in single throw versions in which one of the contact plates may be eliminated or not utilized. Instead of a vacuum pressure, the pressure chamber 34 may be subjected to a pressure condition and the second pressure chamber 36 may be subjected to other pressure conditions to which the switch is desired to be responsive.

Other configurations of the metallic disc 32 are also possible, although as developed in detail above, the particular configuration produces a very advantageous deflection characteristic for the application described. Also, although an automotive manifold vacuum responsive application has been described, the snap action switch according to the present invention could be applied to any number of other situations in which it is desired to sense the fluid pressure conditions in a system.

The embodiments of the invention in which an exclusive property or privilege is claimed are defined as follows:

1. A fluid pressure actuated electrical switching arrangement comprising:

a switch housing having an internal cavity formed therein;

an electrically conductive movable element mounted within said internal cavity subdividing said cavity into respective subchambers sealingly isolated from each other and having a portion thereof movable in response to the development of a predetermined pressure differential thereacross;

an elongated electrical contact member secured to and extending away from a central region of said electrically conductive movable element, and electrically connected thereto, and further including a flange portion connected to said electrical contact member;

a first electrical contact plate fixedly mounted in said housing spaced from said electrically conductive movable element and having an opening through which said electrical contact member extends;

a second electrical contact plate and means biasing said electrically conductive movable element to a position with said flange portion in contact with said second electrical contact plate;

terminal means including a plurality of terminals respectively connected to said first and second electrical contact plates and said electrically conductive movable element;

means creating an electrical connection between said electrically conductive movable element and said first electrical contact plate by movement of said electrically conductive movable element which moves said elongated electrical contact member and said flange portion away from said second contact plate and its contact with said first electrical contact plate in response to development of a predetermined pressure differential condition existing between said subchambers in said switch housing, said means including a portion of said first electrical contact plate positioned in said switch housing to be engaged by said flange portion by movement of said electrically conductive movable element;

a pilot portion secured to said flange portion;

a threaded sleeve having a guide bore formed therein, said pilot portion slidably extending into said bore, said threaded sleeve received in a threaded bore formed in said switch housing;

said second contact plate formed with an opening therein and wherein said pilot portion passes through said opening into said guide bore at a location remote from said second contact plate;

said threaded sleeve adjustable in said threaded bore to be advanced into said threaded bore and abut said second contact plate on a side thereof remote from said electrically conductive movable element, whereby said position of said second contact plate may be adjusted by said adjustment of said threaded sleeve in said threaded bore.

2. The switching arrangement according to claim 1 wherein said switching arrangement further includes an adjustable stop positioned to engage a portion of said electrically conductive movable element on the side thereof remote from said side wherefrom said elongated electrical contact member extends, whereby the end position of said electrically conductive movable element is controlled by contact with said adjustable stop in said direction of movement of said electrically conductive movable element away from said first and second contact plates and whereby in the opposite direction is controlled by contact of said electrically conductive movable element into contact with said second contact plate.

3. The switching arrangement according to claim 1 wherein said means mounting said electrically conductive movable element to said elongated contact member includes means for adjustably positioning said electrical contact member flange portion with respect to said electrically conductive movable element.

4. The switching arrangement according to claim 3 wherein said means for adjustably positioning said contact portion on said electrical contact member includes an engagement surface formed on an axial end surface of said electrical contact member and wherein said guide bore formed in said threaded sleeve passes through the exterior of said switch housing, whereby said adjustment is enabled by insertion of an adjustment tool through said guide bore.

5. A fluid pressure actuated electrical switching arrangement comprising:

a switch housing having an internal cavity formed therein;

an electrically conductive movable element mounted within said internal cavity subdividing said cavity into respective subchambers sealingly isolated from each other and having a portion thereof movable in response to the development of a predetermined pressure differential;

an electrical contact plate fixedly mounted in said housing spaced from said electrically conductive movable element and having an opening through which said electrical contact member extends;

an elongated electrical contact member secured to and extending away from a central region of said electrically conductive movable element, and electrically connected thereto;

said electrically conductive movable element comprising a metallic dome-shaped disc curved towards said first electrical contact plate and further including stop limit means controlling movement of said electrical contact member to limit deflection of said dome-shaped metallic disc to a localized region in the center thereof to produce a reverse curvature in said central localized region only, with a snap action movement of said electrical contact member provided which retains a residual bias by virtue of said metallic disc tending to restore said deflected central portion;

terminal means including a plurality of terminals, one of said plurality of terminals electrically connected to said electrical contact plate and another of said plurality of terminals electrically connected to said electrically conductive movable element;

means creating an electrical connection between said terminal means including a contact ring, means disposing said contact ring in abutment against the periphery of said metallic disk; and means creating an electrical connection between said contact ring and said another of said terminals; said electrical contact plate and said electrical contact member by movement of said electrically conductive movable element carrying said electrical contact member away from said electrical contact plate in response to development of a predetermined pressure differential condition existing between said subchambers in said switch housing.

6. The switching arrangement according to claim 5 wherein said means mounting said electrical contact member to said metallic disc consists of an enlarged head formed on said electrical contact member disposed on one side of said metallic disc and said elongated electrical contact member extending through said metallic disc through an opening formed in said metallic disc and further including a sealing element disposed beneath said head and means securing said sealing portion compressed beneath said head, whereby a resilient sealed connection is provided, said means including an electrically conductive element disposed on the other side of said metallic disc remote from said head, whereby an electrical connection therebetween is established.

7. The switching arrangement according to claim 5 further including a shoulder formed in said housing internal cavity thereagainst; and further including an annular seal interposed between said shoulder and an engaging surface of said metallic disc and means for compressing said metallic disc against said annular seal.

8. The switching arrangement according to claim 7 wherein said shoulder is of a larger diameter than said metallic disc, whereby a radial clearance is provided accommodating radial expansion thereof upon deflection of said central localized region.

9. A fluid pressure actuated electrical switching arrangement comprising:

a switch housing having an internal cavity formed therein;

an electrically conductive movable element comprising a dome-shaped metallic disc mounted within said internal cavity subdividing said cavity into respective subchambers sealingly isolated from each other;

an elongated electrical contact member extending axially away from the center region of said electrical contact plate;

means electrically and mechanically connecting said electrical contact member to said center of said metallic disc to cause movement together therewith;

adjustable stop means disposed adjacent a side of said center region of said metallic disc opposite said axial direction in which said electrical contact member extends limiting movement of said center region in the direction opposite said electrical contact member;

means adjustably limiting the extent of axial movement of said electrical contact member and said connected center region away from said adjustable stop means, said metallic disc thickness and diameter allowing reverse curvature dimpling of said center region in one position of said center region as limited by said adjustable stop means or said means adjustably limiting said extent of axial movement of said electrical contact member;

terminal means including at least one electrical terminal;

electrical connection means creating an electrical connection between said electrical contact member and said at least one electrical terminal in one of said positions of said electrical contact member and breaking said electrical connection upon movement of said electrical contact member to said other position;

whereby the pressure differential causing dimpling and flattening of said metallic disc are both adjustable by said respective adjustable means to make and break said electrical connection in response to changes in differential pressure.

10. The switching arrangement according to claim 9 wherein said means mounting said electrically conductive movable element to said elongated contact member includes means for adjustably positioning a portion of said electrical contact member with respect to said electrically conductive movable element.

11. A fluid pressure actuated electrical switching arrangement comprising:

a switch housing having an internal cavity formed therein;

an electrically conductive movable element comprising a dome-shaped metallic disc mounted within said internal cavity subdividing said cavity into respective subchambers sealingly isolated from each other;

an elongated electrical contact member extending axially away from the center region of said electrically conductive movable element;

means electrically and mechanically connecting said electrical contact member to said center region of said metallic disc, said means including an enlarged head formed on said electrical contact member disposed on one side of said metallic disc and said elongated electrical contact member extending through said metallic disc center region through an opening formed in said metallic disc with a clearance space therebetween and further including a resilient sealing element disposed beneath said head and means securing said sealing portion compressed beneath said head, whereby a resilient sealed connection is provided, said means for further including an electrically conductive element secured on said electrical contact member and the other side of said metallic disc remote from said head and in engagement with said center region, whereby an electrical connection therebetween is established;

terminal means including at least one electrical terminal;

means creating and breaking an electrical connection between said electrical contact member and said at least one electrical terminal in response to predetermined movement of said electrical contact member in response to dimpling deflection of said center region, whereby said means connecting said electrical contact member accommodates said dimpling while sealing said subchambers, creating said electrical and mechanical connection.

* * * * *

UNITED STATES PATENT AND TRADEMARK OFFICE

CERTIFICATE OF CORRECTION

PATENT NO. : 4,238,651

DATED : 12/9/80

INVENTOR(S) : DAVID TANN

It is certified that error appears in the above-identified patent and that said Letters Patent are hereby corrected as shown below:

Column 4, line 21, "switch" should be --switch 10--.

Column 6, line 19, "radical" should be --radial--.

Column 8, line 3, "its" should be --into--.

Signed and Sealed this

*Twenty-third* Day of *June 1981*

[SEAL]

*Attest:*

RENE D. TEGTMEYER

*Attesting Officer* *Acting Commissioner of Patents and Trademarks*